US005419590A

United States Patent [19]

Rothschild

[11] Patent Number: 5,419,590

[45] Date of Patent: May 30, 1995

[54] PRESSURE SEAL DELIVERY NOTE

[75] Inventor: Mark R. Rothschild, Johannesburg, South Africa

[73] Assignee: Moore Business Forms, Inc., Grand Island, N.Y.

[21] Appl. No.: 90,693

[22] Filed: Jul. 13, 1993

[51] Int. Cl.[6] ..... B42D 15/00

[52] U.S. Cl. ..... 283/79; 462/6; 462/12; 281/7

[58] Field of Search ..... 283/116, 79, 80, 56, 283/62; 281/2, 3.1, 5, 7, 10; 462/6, 7, 8, 12

[56] References Cited

U.S. PATENT DOCUMENTS

| | | |
|---|---|---|
| 1,708,574 | 4/1929 | Hazen . |
| 2,669,464 | 2/1954 | Lay et al. . |
| 3,126,148 | 3/1964 | Hanson . |
| 3,152,800 | 10/1964 | Hanson . |
| 3,184,150 | 5/1965 | Hubbard . |
| 3,701,468 | 10/1972 | Steinhauser . |
| 3,977,597 | 8/1976 | Wise et al. . |
| 5,046,661 | 9/1991 | Kimura . |

FOREIGN PATENT DOCUMENTS

| | | |
|---|---|---|
| 0128643 | 4/1984 | European Pat. Off. . |
| 201960 | 11/1986 | European Pat. Off. . |
| 2400465 | 4/1979 | France . |
| 1534844 | 12/1978 | United Kingdom . |

*Primary Examiner*—Willmon Fridie
*Attorney, Agent, or Firm*—Nixon & Vanderhye

[57] ABSTRACT

A business form intermediate and business form provide—from a single sheet of paper—a combined delivery receipt form/note for a supplier and a sealed document for a customer listing items delivered and an invoice. A sheet of paper is divided into three substantially equal panels by first and second fold lines extending between the top and bottom edges. The second fold line is preferably a perforation to aid easy detachment of the third panel which forms a delivery receipt note and which bears transfer material, e.g. in the form of a carbon patch, on its inner surface. The first and second panels carry adhesive around their free edges and are designed to be printed with details of items being delivered and an invoice, and then to be brought together and sealed around their edges to provide a sealed form-/document. The customer is intended to sign the outside of the delivery note in an area corresponding to the transfer material so that the signature is transferred through to the sealed form. The supplier's representative then detaches the receipted (third) panel and the customer passes the sealed document to his accounts department.

30 Claims, 3 Drawing Sheets

PRESSURE SEAL DELIVERY NOTE

BACKGROUND AND SUMMARY OF THE INVENTION

This invention relates to a business form, and a business form intermediate, especially designed to provide from a single sheet a combined delivery receipt form for a supplier and sealed document for a customer, preferably the sealed document including details of items delivered and an invoice therefor.

The invention allows delivery of a sealed document to a customer, while still readily providing a receipt which does not become attached from the document until signed, and is constructed in a simple and effective manner.

According to one aspect of the present invention an intermediate for a business form is provided which comprises the following elements: A quadrate sheet of paper having first and second faces, first and second end edges, and first and second side edges. First and second fold lines provided in the sheet, extending generally parallel to the end edges, and defining the sheet into first, second, and third panels, the first panel between the first end edge and first fold line, the third panel between the second fold line and second end edge, and the second panel between the first and second panels. Adhesive means provided on the first face of the first and second panels, positioned to hold the first and second panels together with tile first faces thereof in face to face contact when the sheet is folded about the first fold line. The third panel, and the second face of both of the first and second panels, being essentially devoid of adhesive. And, indicia imaged on at least one of the first and second faces of the third panel.

The second fold line may comprise a line of weakness, and an image transfer means may be provided on a face of the third panel opposite the indicia. The image transfer means may comprise a localized carbon spot, or a CB spot or coat with a cooperating CF spot or coat provided on the second face of at least one of the first and second plies. Typically the indicia is provided on the third panel second face and the image transfer means on the third panel first face, and indicia is also provided on the first panel second face including a plurality of common elements with the indicia on the third panel second face, so that if the intermediate is folded about the first and second fold lines the third panel overlies the first panel, the common indicia elements of the first and third panels then being in alignment.

The adhesive means may comprise pressure seal adhesive. It may be provided in a configuration such that first adhesive patterns (e.g. strips) are formed adjacent the side edges of the first face of the sheet on the first and second panels, a second adhesive pattern adjacent the first end edge on the first panel first face, and a third adhesive pattern adjacent the second fold line on the second panel first face. Lines of weakness may be formed in the sheet on the opposite sides of the side edges from the first adhesive patterns on the opposite side of the first end edge from the second adhesive pattern, and on the opposite side of the second fold line from the third adhesive pattern.

Preferably, the indicia comprises delivery receipt indicia. Also the first and second panels typically have substantially identical dimensions, and while the third panel may have different dimensions (particularly a narrower "width", typically the length being the same), it is also desirably substantially identical in dimension with the first and second panels.

According to another aspect of the present invention, a business form is provided. The business form comprises the following elements: First and second quadrate plies of paper, each ply having an inner face and an outer face, and first through fourth edges. Means for holding the first and second plies together at all of the first through fourth edges with the inner faces thereof in face to face engagement. A third quadrate ply having first and second faces, and first through fourth edges and attached to at least one of the first and second plies at the first edge thereof, but essentially free of the first and second plies at the second through fourth edges thereof. And, indicia imaged on the first face of the third ply.

The business form also preferably comprises at least localized transfer means disposed on the second face of the third ply, for transferring images imaged on the first face to one of the first and second ply outer faces when the third ply overlies one of the first and second ply outer faces. The transfer means may comprise a localized carbon spot on the third ply second face, or CB and CF coatings on the second face of the third ply, and on one of the first and second ply outer faces, respectively.

The business form also preferably comprises second indicia imaged on the inner faces of the first and second plies, such as invoice indicia when the first indicia comprises first delivery receipt indicia. Third indicia comprising delivery receipt indicia generally comparable to the first indicia, is disposed on the first ply outer face and in alignment with the first indicia when the third ply is folded about the first edge so that it overlies the second ply outer face. At least the first and second plies typically have the same dimensions, and the third ply normally does too.

The first edge of the third ply is typically integral with, formed from the same sheet of paper, one of the edges of the second ply, and a line of weakness (e.g. perforation) is provided at the first edge. The holding means preferably comprises patterns of adhesive along three edges of the first and second plies, and an integral paper connection at the fourth edge, and lines of weakness may be formed adjacent the adhesive patterns in the first and second plies to allow ready tearing of the first and second plies to expose the inner faces thereof.

In a typical use of the invention, a set of such business forms, normally produced in known manner from a continuous web of paper, will be printed with standard instructions for completion and use and with the name of the supplier. Each form will then be completed by the supplier with details of items being delivered and the customer's name and address, these details showing both on the delivery receipt note and the exterior of the sealed document and with an invoice for those items being printed on or enclosed within the interior of the sealed document.

When the items are delivered the customer is asked to sign for receipt on the outside of the delivery note in the area corresponding with the localized carbon patch (or other image transfer means). By virtue of the carbon patch, this signature transfers through onto the sealed document; the delivery receipt note is then detached from the sealed document and the customer is asked to pass the sealed document to his accounts department while the supplier's representative keeps the delivery receipt note with the original signature (and stamp of the customer if appropriate).

It is the primary object of the present invention to provide a simple yet effective intermediate and business form which hold information confidential in a sealed document, yet have an integral yet readily detachable receipt portion associated therewith. This and other objects of the invention will become clear from an inspection of the detailed description of the invention, and from the appended claims.

DETAILED DESCRIPTION OF THE DRAWINGS

Figure 1:
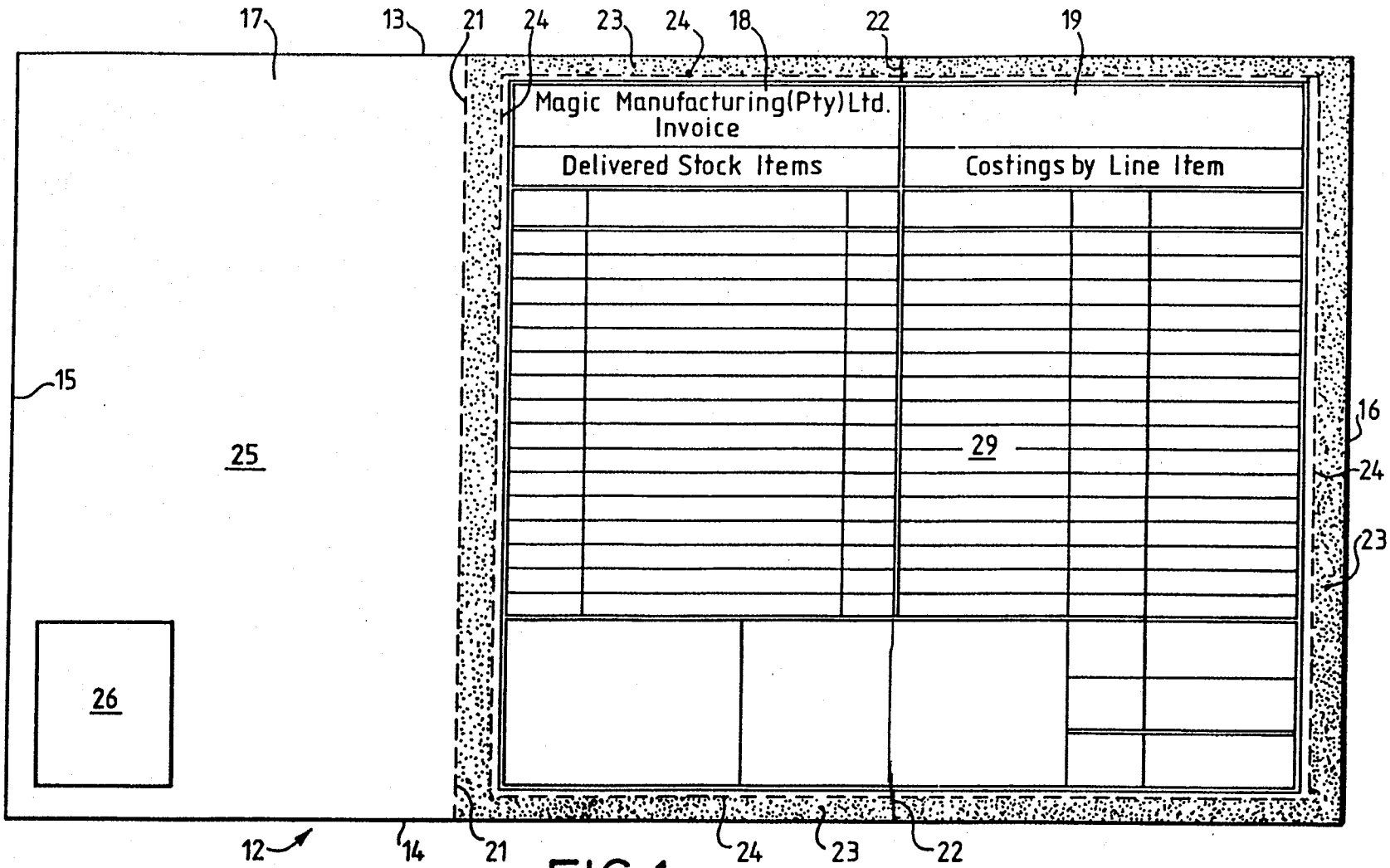
FIG. 1 is a plan view of a first face of a business form intermediate according to the present invention.
Figure 2:
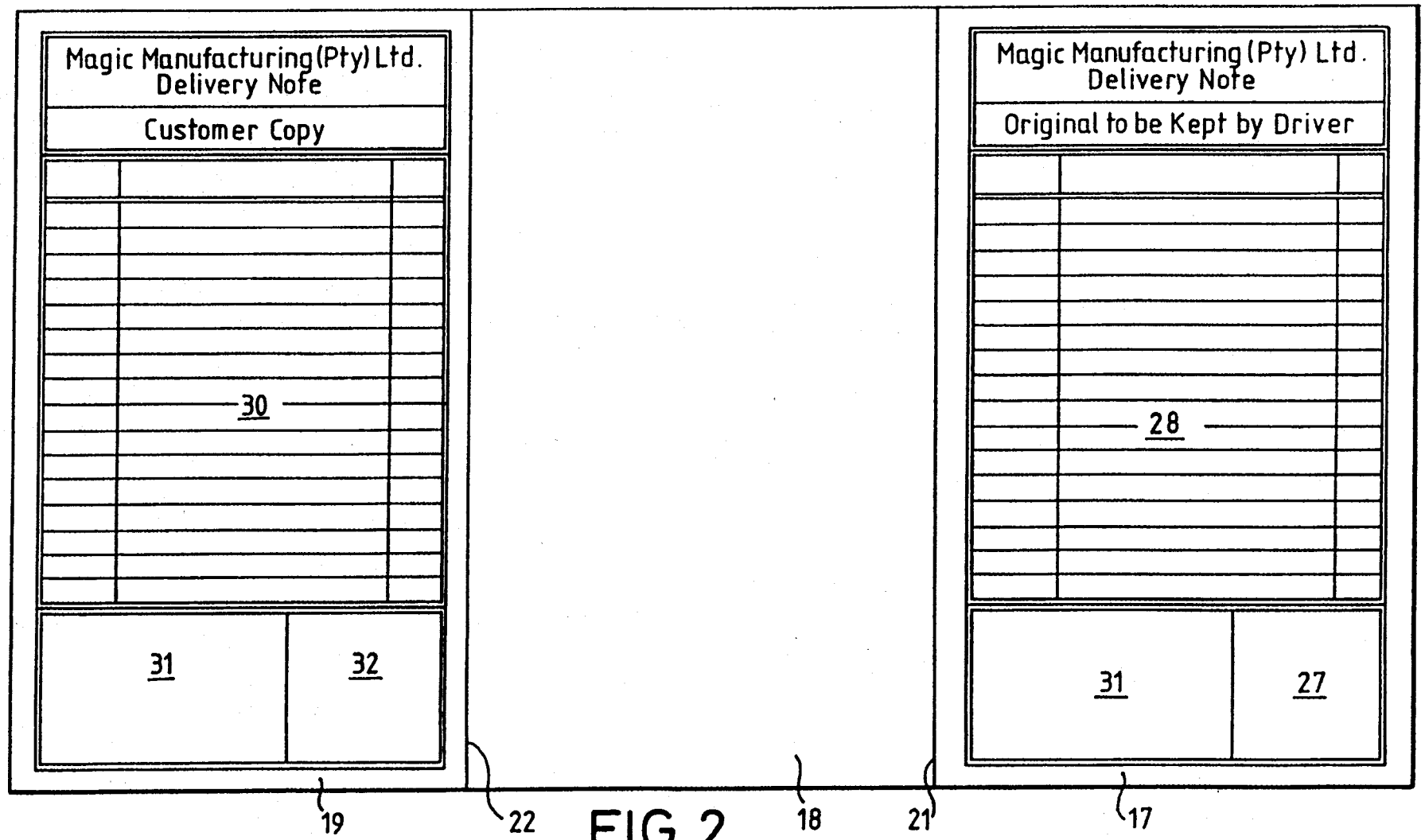
FIG. 2 is a plan view of the second, opposite from FIG. 1, face of an exemplary immediately according to the present invention.

A business form intermediate according to the invention is seen in FIGS. 1 and 2 and comprises a quadrate (e.g. rectangular) sheet of paper 12 having top and bottom edges 13, 14 and side edges 15, 16 and divided into three substantially equal panels 17, 18, 19 (third through first panels, respectively) by first and second fold lines 21, 22 extending between the top and bottom edges. The first fold line 21 may be formed by a perforation to aid easy detachment of the left hand (third) panel 17 (forming a delivery receipt form/note) from the central (second) panel 18. The fold line 22 could also be formed as perforation or line of weakness to allow easy detachment of the first panel 19 from the second panel 18.

The panels 18, 19 are intended to form a sealed document in the final business form (see FIG. 3) and for this purpose they are provided around their edges (except adjacent the fold line 22, which is an integral paper connection or holding means) with patterns of pressure seal adhesive 23, such as continuous or discontinuous strips, so that when the first panel 19 is folded over onto the second panel 18 and the edges subjected to pressure they are sealed together by adhesive 23. Other forms of adhesive could be used in which case adhesive need not extend around the edges of both panels provided it extends around the free edges of the folded document. Lines of weakness (e.g. perforations) 24 are preferably formed inside the lines of adhesive for eventual opening of the sealed document.

The third panel 17 is designed to fold over to overlie the outer surface of the first panel 19 or it could be folded the other way to overlie the outer surface of the second panel 18.

The inner surface 25 of panel 17 bears a localized area or patch 26 of self-copy/transfer material, e.g. a carbon patch adhered thereto by cold adhesive. Alternatively the patch of carbon may be printed on the surface 25 directly, and may cover the whole surface rather than be localized, or a separate carbon insert may be provided. Alternatively, conventional CB/CF coatings may be formed on the surface 25 and cooperating surface 30 of panel 19, respectively. The patch 26 will register with an underlying area indicated at 27 on the outer surface 32 of the panel 19.

The inner surfaces 29 of the panels 18 and 19 of a set of forms may be preprinted (imaged) with indicia such as the name of the supplier and his details and with headings, boxes and instructions for completion of personalized information, such as customer's name, a list of items being delivered and an invoice for those items, etc. The outer surfaces 30, 28 of the panels 19 and 17, respectively, may be preprinted with headings and boxes for receiving personalized information such as details of the items being delivered, e.g. delivery indicia as illustrated. A box 31 is provided for receiving the customer's name and address details, and a box 27 is provided on surface 28 (coinciding with the area of the patch 26 on the other side of the panel 17) for receiving the customer's signature, a date and a rubber stamp impression if appropriate. All this information, which is common to all forms, may be printed on each form at the same time as the personalized printing.

Figure 3:
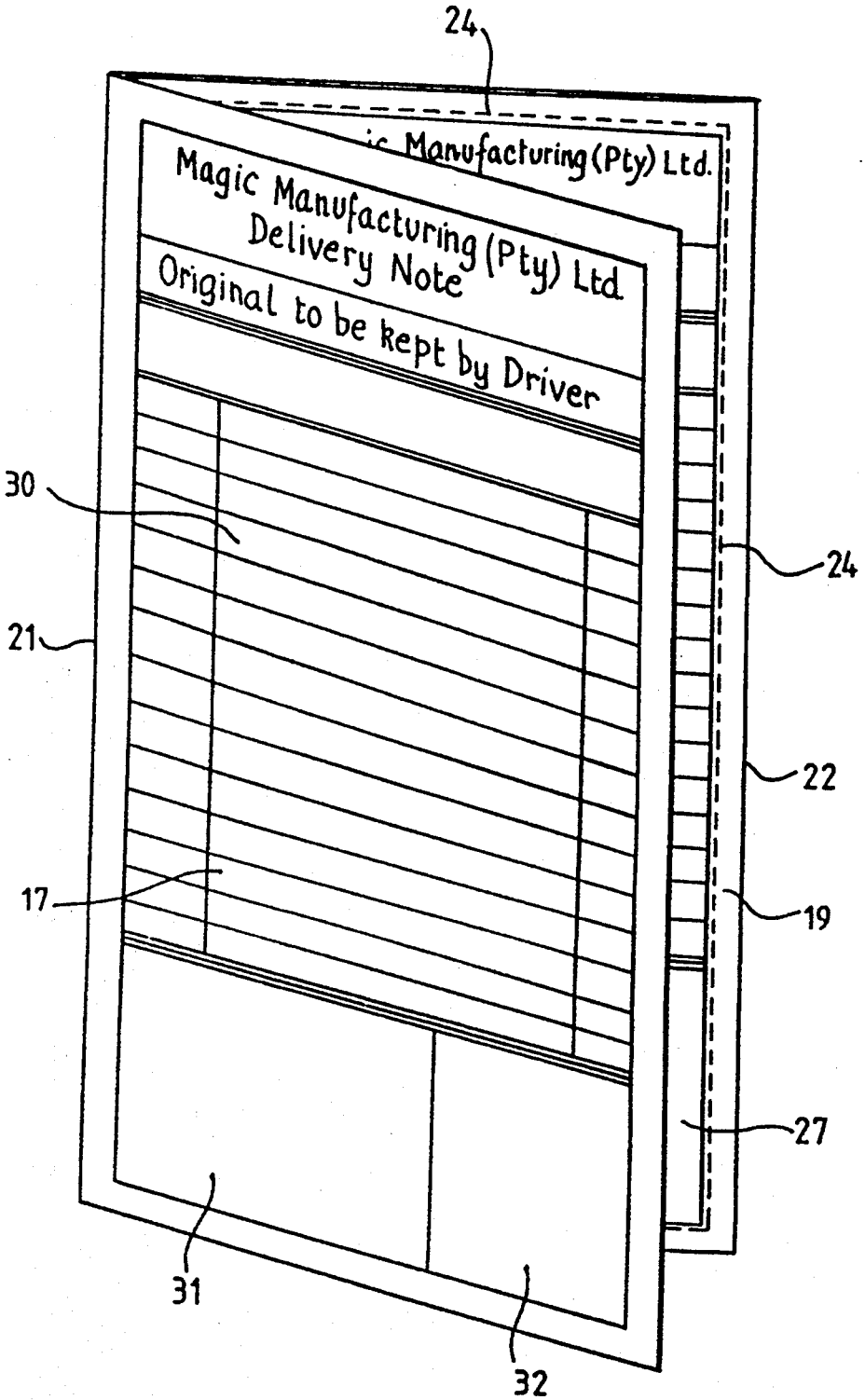
FIG. 3 is a perspective view of a business form according to the present invention formed by folding of the intermediate of FIGS. 1 and 2.

In use, each form is completed with personalized details of the items being delivered, an invoice for those items and the customer' name and address details. This is normally done by a computer controlled printer printing on both sides of the form. The document is then folded about lines 21, 22 as seen in FIG. 3, and sealed by activating the adhesive. When the items are delivered the supplier's representative, making the delivery, gets the customer to sign to acknowledge receipt in the area 27 and the signature is automatically transferred onto the area 32 on the outside of the sealed business form. The delivery receipt note is then detached along the perforations of the fold line 22 and retained by the supplier's representative while the customer is asked to deliver the sealed business form to his accounts department for processing of the invoice.

With such a business form the invoice does not need to be separately prepared and delivered and the invoice itself bears an acknowledgement of receipt by the customer.

Any of the panels may be subdivided, for example by lines of perforations, to provide, for example a return stub to be included with payment of the invoice.

A further, non-adhesive bearing panel, could be connected by a (tearable) fold line to the delivery receipt panel so that, after printing with information of the items delivered (but not the price) it can be folded under the delivery note and could provide a further list e.g. the items for use by the customer's stock controller. Such an additional panel could either be provided with a cut-out in the area corresponding to the patch or further transfer material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An intermediate for a business form, comprising:

a quadrate sheet of paper having first and second faces, first and second end edges, and first and second side edges;

first and second fold lines provided in said sheet, extending generally parallel to said end edges, and defining said sheet into first, second, and third panels, said first panel between said first end edge and first fold line, said third panel between said second fold line and second end edge, and said second panel between said first and second panels, said second fold line comprising a line of weakness;

adhesive means provided on said first face of said first and second panels, positioned to hold said first and second panels together with said first faces thereof in face to face contact when said sheet is folded about said first fold line;

said third panel, and said second face of both of said first and second panels, being essentially devoid of adhesive; and indicia imaged on at least one of said first and second faces of said third panel.

2. An intermediate as recited in claim 1 further comprising image transfer means provided on a face of said third panel opposite said indicia.

3. An intermediate as recited in claim 2 wherein said image transfer means comprises a localized carbon spot.

4. An intermediate as recited in claim 2 wherein said image transfer means comprises a CB spot or coat, and further comprising a CF spot or coat provided on said second face of at least one of said first and second panels.

5. An intermediate as recited in claim 2 wherein said indicia is provided on said third panel second face, and said image transfer means on said third panel first face; and further comprising indicia provided on said first panel second face including a plurality of common elements with said indicia on said third panel second face, so that if said intermediate is folded about said first and second fold lines so that said third panel overlies said first panel, said common indicia elements of said first and third panels are in alignment.

6. An intermediate as recited in claim 1 wherein said adhesive means comprises pressure seal first adhesive patterns formed adjacent said side edges of said first face of said sheet on said first and second panels, a second adhesive pattern adjacent said first end edge on said first panel first face, and a third adhesive pattern adjacent said second fold line on said second panel first face.

7. An intermediate as recited in claim 1 wherein said indicia comprises delivery receipt indicia.

8. An intermediate as recited in claim 1 further comprising image transfer means provided on a face of said third panel opposite said indicia.

9. An intermediate as recited in claim 8 wherein said indicia is provided on said third panel second face, and said image transfer means on said third panel first face; and further comprising indicia provided on said first panel second face including a plurality of common elements with said indicia on said third panel second face, so that if said intermediate is folded about said first and second fold lines so that said third panel overlies said first panel, said common indicia elements of said first and third panels are in alignment.

10. An intermediate as recited in claim 9 wherein said indicia comprises delivery receipt indicia.

11. An intermediate as recited in claim 6 further comprising lines of weakness formed in said sheet on the opposite sides of said side edges from said first adhesive patterns, on the opposite side of said first end edge from said second adhesive pattern, and on the opposite side of said second fold line from said third adhesive pattern.

12. An intermediate as recited in claim 1 wherein said first and second panels have substantially identical dimensions.

13. An intermediate as recited in claim 12 wherein said third panel has dimensions substantially identical to said first and second panels.

14. A business form comprising:

first and second quadrate plies of paper, each ply having an inner face and an outer face, and first through fourth edges;

means for holding said first and second plies together at all of said first through fourth edges with said inner faces thereof in face to face engagement;

a third quadrate ply having first and second faces, and first through fourth edges and attached to at least one of said first and second plies at said first edge thereof, but essentially free of said first and second plies at said second through fourth edges thereof;

indicia imaged on said first face of said third ply; and at least localized transfer means disposed on said second face of said third ply, for transferring images imaged on said first face to one of said first and second ply outer faces when said third ply overlies one of said first and second ply outer faces.

15. A business form as recited in claim 14 wherein said holding means comprise patterns of adhesive along three edges of said one or both of first and second plies, and an integral paper connection at the fourth edge.

16. A business form as recited in claim 14 wherein said image transfer means comprises a localized carbon spot on said third ply second face.

17. A business form as recited in claim 14 wherein said indicia comprises first delivery receipt indicia.

18. A business form as recited in claim 17 further comprising second indicia receipt indicia generally comparable to said first indicia, and provided on said outer face of said first ply in alignment with said first delivery receipt indicia when said third ply is pivoted about said first edge thereof to a position over said first ply outer face.

19. A business form as recited in claim 18 wherein said first edge of said third ply is integral with, formed from the same sheet of paper, one of said edges of said second ply, a line of weakness provided at said first edge.

20. A business form as recited in claim 14 further comprising indicia imaged on said inner faces of said first and second plies.

21. A business form as recited in claim 15 further comprising lines of weakness formed adjacent said adhesive patterns in said first and second plies to allow ready tearing of said first and second plies to expose the inner faces thereof.

22. A business form comprising:

first and second quadrate plies of paper having substantially the same dimensions, each ply having an inner face and an outer face, and first through fourth edges;

means for holding said first and second plies together at all of said first through fourth edges with said inner faces thereof in face to face engagement;

a third quadrate ply having first and second faces, and first through fourth edges, and attached to at least one of said first and second plies at said first edge thereof, but essentially free of said first and second plies at said second through fourth edges thereof;

first indicia imaged on said first face of said third ply; and second indicia imaged on said inner faces of said first and second plies.

23. A business form as recited in claim 22 wherein said third ply has substantially the same dimensions as said first and second plies.

24. A business form as recited in claim 22 wherein said first indicia comprises delivery receipt indicia, and further comprising third indicia comprising delivery receipt indicia generally comparable to said first indicia, disposed on said first ply outer face and in alignment with said first indicia when said third ply is folded about said first edge so that it overlies said first ply outer face; and wherein said second indicia includes invoice indicia.

25. A business form as recited in claim 23 wherein said holding means comprise patterns of adhesive along three edges of said one or both of first and second plies, and an integral paper connection at the fourth edge.

26. A business form as recited in claim 25 further comprising lines of weakness formed adjacent said adhesive patterns in said first and second plies to allow ready tearing of said first and second plies to expose the inner faces thereof.

27. A business form as recited in claim 24 wherein said first edge of said third ply is integral with, formed from the same sheet of paper, one of said edges of said second ply, a line of weakness provided at said first edge.

28. An intermediate as recited in claim 1 besides indicia and fold or perforation lines consisting essentially of said first through third panels, and adhesive means.

29. A business form as recited in claim 15 besides indicia and fold or perforation lines consisting essentially of said first through third plies and adhesive means.

30. A business form as recited in claim 14 wherein said first edge of said third ply is integral with, formed from the same sheet of paper, one of said edges of said second ply, a line of weakness provided at said first edge.

* * * * *